US005605447A

United States Patent [19]

Kim et al.

[11] Patent Number: 5,605,447

[45] Date of Patent: Feb. 25, 1997

[54] NOISE REDUCTION IN A HERMETIC ROTARY COMPRESSOR

[75] Inventors: Han-Jun Kim, Liverpool, N.Y.; In-Soo Hwang, Kyungki-do, Rep. of Korea

[73] Assignee: Carrier Corporation, Syracuse, N.Y.

[21] Appl. No.: 676,870

[22] Filed: Jul. 3, 1996

[51] Int. Cl.[6] ..... F04B 39/00; F04C 29/06

[52] U.S. Cl. ..... 417/312; 181/403; 417/902; 418/63

[58] Field of Search ..... 417/312, 902; 181/403; 418/63

[56] References Cited

U.S. PATENT DOCUMENTS

| | | | |
|---|---|---|---|
| 4,730,996 | 3/1988 | Akatsuchi et al. | 418/63 |
| 4,927,342 | 5/1990 | Kim et al. | 181/403 |
| 4,932,851 | 6/1990 | Kim | 418/63 |

FOREIGN PATENT DOCUMENTS

| | | | |
|---|---|---|---|
| 0079192 | 5/1985 | Japan | 417/312 |
| 0210286 | 9/1986 | Japan | 417/312 |

*Primary Examiner*—Timothy Thorpe
*Assistant Examiner*—William Wicker

[57] ABSTRACT

The present invention concerns a noise reduction method and a noise reduction device for a hermetic rotary compressor. It is designed to reduce the very high level of low frequency sound generated by the compressor by preventing the formation of reflected waves along the circumference which produce the resonant sound mode, and thus by preventing the amplification of the low frequency gas pulsations. In the present invention, the amplitude of the reflected waves that form the resonant sound mode is reduced by installing the muffler outlets at one half the wavelength of the reflected waves in the cavity of the compressor housing from the exhaust valve where the compressed gas from the cylinder enters the muffler. By positioning these outlets to face each other so that, of the pulsating gas components form these two outlets, those at the frequency of the reflected waves formed in the circumferential direction of the cavity of the compressor housing will undergo a 180° phase shift and destructively interfere with each other.

4 Claims, 3 Drawing Sheets

NOISE REDUCTION IN A HERMETIC ROTARY COMPRESSOR

BACKGROUND OF THE INVENTION

In hermetic compressors having a muffler, it has been found that resonant sound modes are formed by the gas pulsation at certain frequencies that produce reflected waves along the inner circumference of the compressor shell or housing. This "gas sloshing resonance" therefore occurs in the annular space between the muffler and the compressor shell.

SUMMARY OF THE INVENTION

The present invention solves the problems associated with the production of reflected waves or gas sloshing resonance. The main object of the present invention is to reduce the high-amplitude, low-frequency sound (below 1000 Hz) generated by the compressor. Accordingly, the present invention inhibits the formation of reflected waves along the circumference of the annular space between the muffler and the compressor shell that produce the resonant sound mode, and thereby prevents the low-frequency component of gas pulsation from being amplified. In a high side hermetic rotary compressor, the high pressure discharge refrigerant gas serially passes from the compression chamber into the muffler chamber defined by the muffler and the motor end bearing. The compressed refrigerant gas passes from the muffler into the annular space between the muffler and the shell and then passes from the annular space to the discharge line of the refrigeration or air conditioning system. A conventional muffler outlet is modified to prevent the formation of reflected waves along the circumference of the annular space, and to reduce the amplitude of gas pulsations whose frequencies correspond to the representative circumference of the cavity inside the compressor housing. This modification is aimed at reducing the low-frequency pure tone of the compressor's sound and is achieved by providing a single entrance into the muffler for receiving the compressed gas from the compression discharge chamber, and two discharge ports from the muffler into the interior volume of the shell. The two discharge ports are ideally a half wavelength of the reflected wave apart to achieve canceling between the two flow paths. However, a separation down to a quarter wavelength will also achieve significant noise canceling.

Two outlets are separated by ¼ to ½ of the wavelength of the reflected waves along the circumference of the muffler that supports the resonant sound mode. Also, the two outlets are positioned to face each other relative to flow exiting therefrom. As a result, of the gas pulsation components formed along the circumference of the cavity of the compressor housing, those components at the frequency of the reflected waves will undergo a 180° phase shift and interfere with each other to produce canceling.

Basically, the present invention achieves the noise reduction by providing two muffler outlets. The two outlets are located on the perpendicular surface (or inclined surface) of the muffler so that the gas from these outlets can flow in the same plane but in opposite circumferential directions. The aforementioned two outlets should be positioned so that the distance between the muffler outlets is ¼ to ½ of the wavelength of the reflected wave which creates the resonant sound mode. These two outlets should be placed to face each other so that the gases from these outlets will meet.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 3:
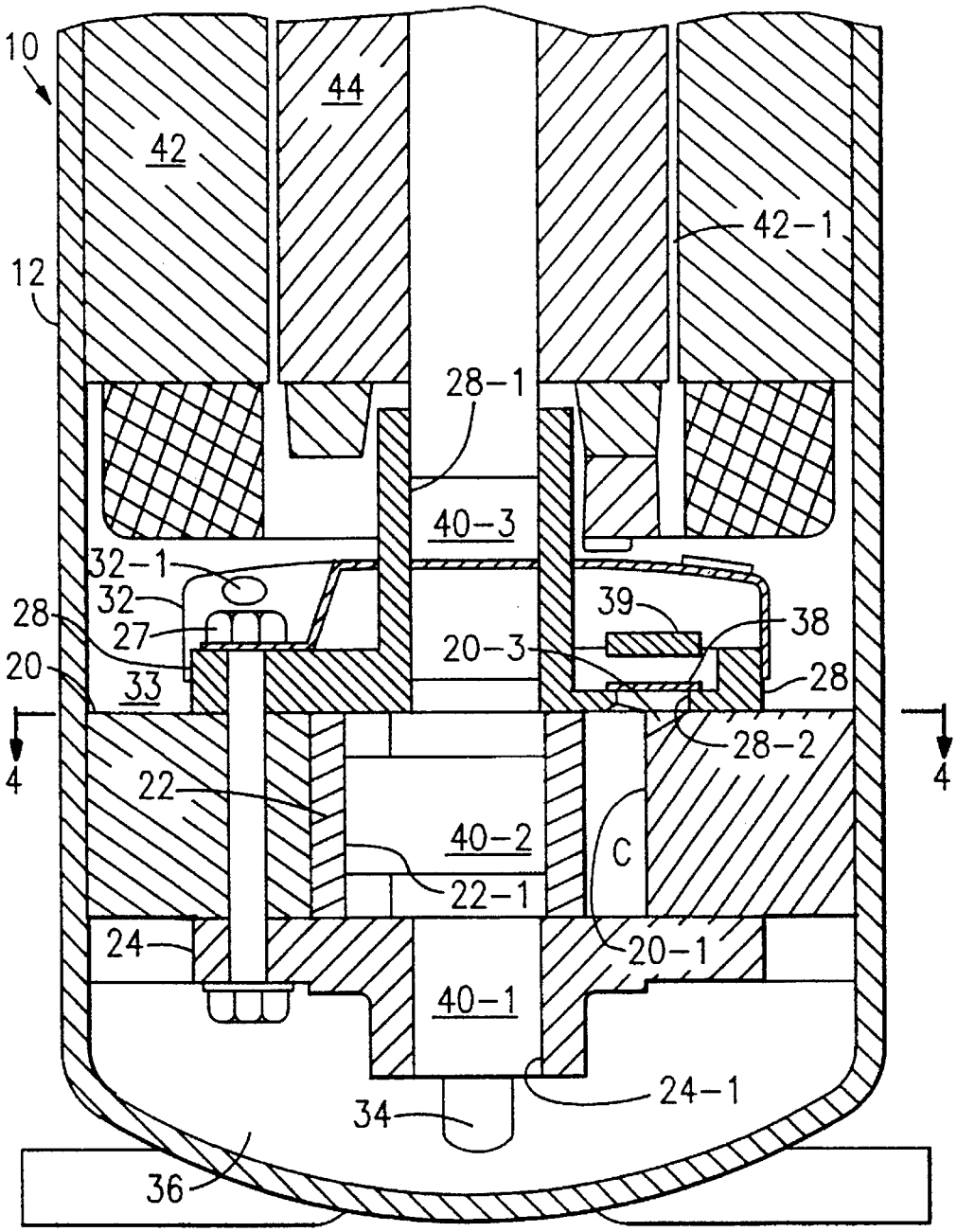
FIG. 3 is a vertical sectional view of a portion of a high side compressor employing the muffler of the present invention.
Figure 4:
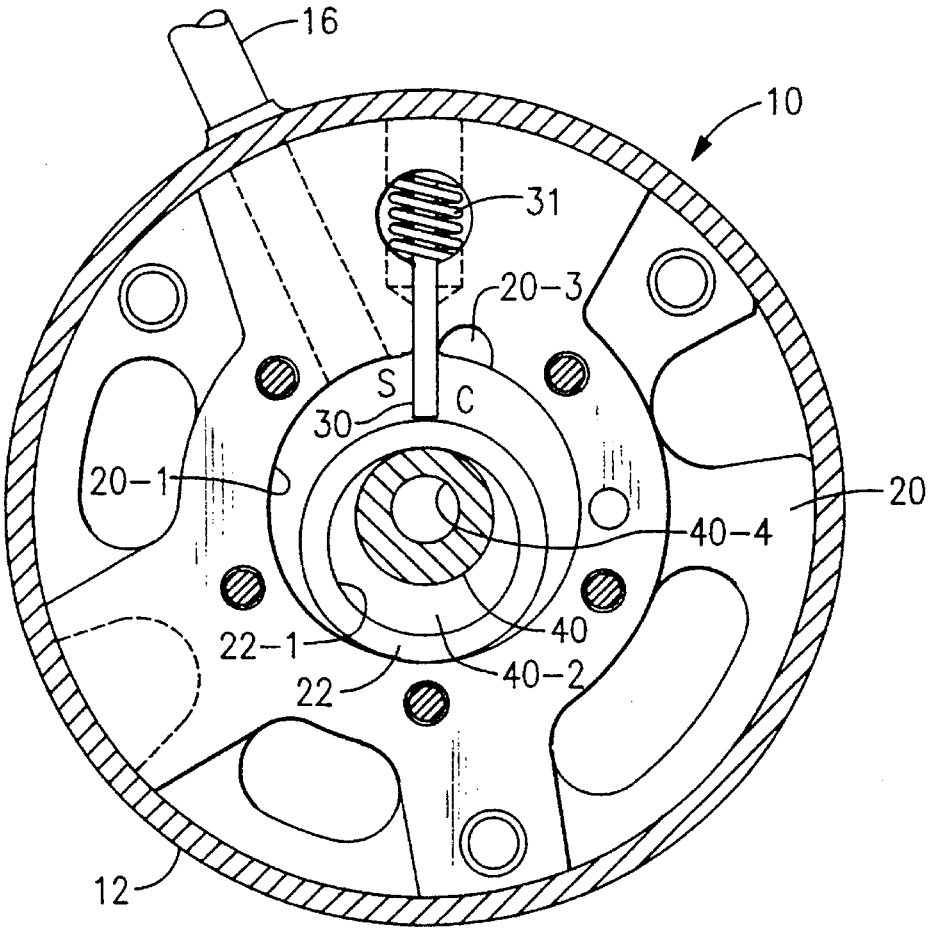
FIG. 4 is a sectional view taken along line 4—4 of FIG. 3.

In FIGS. 3 and 4, the numeral 10 generally designates a vertical, high side rolling piston compressor. The numeral 12 generally designates the shell or casing. Suction tube 16 is sealed to shell 12 and provides fluid communication between a suction accumulator (not illustrated), which is connected to the evaporator (not illustrated), and suction chamber S. Suction chamber S is defined by bore 20-1 in cylinder 20, piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define an electric motor. Vane 30 is biased into contact with piston 22 by spring 31.

Discharge port 28-2 is formed in motor end bearing 28 and partially overlies bore 20-1 and overlies discharge recess 20-3 which is best shown in FIG. 4 and which provides a flow path from compression chamber C to discharge port 28-2. Discharge port 28-2 is serially overlain by discharge valve 38 and spaced valve stop 39, as is conventional. As described so far, compressor 10 is generally conventional.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. Oil delivered to bore 40-4 is able to flow into a series of radially extending passages, in portion 40-1, eccentric 40-2 and portion 40-3 to lubricate bearing 24, piston 22, and beating 28, respectively. Piston 22 coacts with vane 30 in a conventional manner such that gas is drawn through suction tube 16 and passageway 20-2 to suction chamber S. The gas in suction chamber S is trapped, compressed and discharged from compression chamber C via recess 20-3 into discharge port 28-2. The high pressure gas unseats the valve 38 and passes into the interior of muffler 32. The compressed gas passes through muffler 32 through outlets 32-1 and 32-2 into the cavity 33 defined by muffler 32 and interior of shell 12 and passes via the annular gap between rotating rotor 44 and stator 42 and through a discharge line (not illustrated) to the condenser (not illustrated) of a refrigeration circuit (not illustrated).

In a PRIOR ART device having only a single outlet rather than outlets 32-1 and 32-2, the refrigerant gas released from compression chamber C would pulsate over a wide range of frequencies. This pulsation is the main noise source of the PRIOR ART compressors, and it can be reduced by installation of the muffler 32 of the present invention.

That is, the resonant sound mode or gas sloshing resonance is created in cavity 33 of compressor shell 12 by reflected waves formed in cavity 33 in the PRIOR ART compressors. Consequently, the gas pulsation at a specific frequency that corresponds to that of the resonant sound mode in the cavity 33 is amplified. Low frequency sound generated by PRIOR ART compressors in connection with the aforementioned resonant sound mode within the compressor housing 12 overlaps with high amplitude fan noise in a similar frequency band when the compressor is attached to an air conditioner. As a result, the total noise amplitude of the air conditioner increases and the sound becomes worse. Even when an interceptor is installed in the air conditioner, it is not very effective in reducing such low frequency sound compared to the high frequency components.

Figure 1:
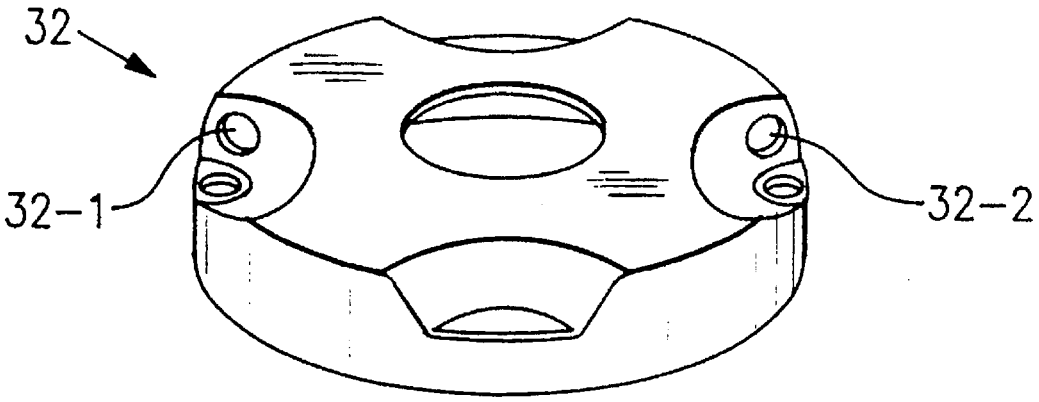
FIG. 1 is a pictorial view of the muffler of the present invention.
Figure 2:
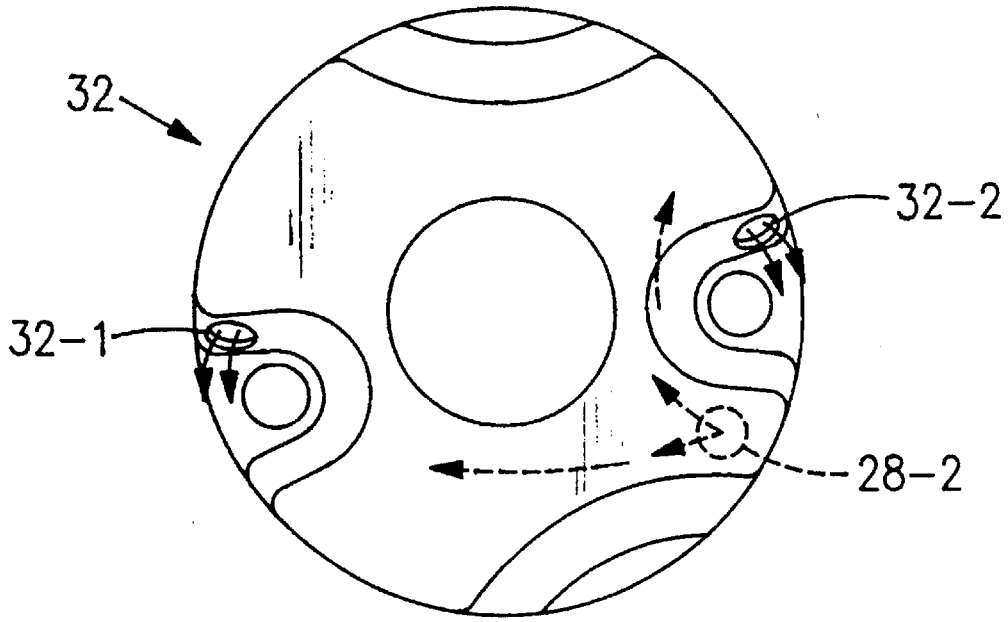
FIG. 2 is a top view showing the muffler of FIG. 1 showing the gas flow.

Referring specifically to FIGS. 1 and 2, it will be readily seen that muffler 32 has two circumferentially spaced outlets 32-1 and 32-2 which are in facing/opposing directions relative to the interior of shell 12 and more specifically with respect to annular cavity 3 defined between shell 12 and muffler 32, as best illustrated in FIG. 3. However, it is preferable to place outlets 32-1 and 32-2 on the perpendicular surface (or inclined surface) of muffler 32 whose normal line is tangent to the outside diameter of the muffler 32, so that the gas exiting outlets 32-1 and 32-2 flows, respectively, in the same plane but in opposite circumferential directions.

The two outlets 32-1 and 32-2 of muffler 32 should be placed at a distance that is normally one half the wavelength of the reflected wave produced in cavity 33 of the compressor shell 12 from the discharge valve 38, i.e., the muffler inlet is effectively the port 28-2 controlled by valve 38 and is where the compressed gas exiting the compression chamber C enters muffler 32. Additionally, outlets 32-1 and 32-2 of muffler 32 should be placed at a distance that is normally one half the wavelength of the reflected waves produced in cavity 33 of the compressor shell 12 from port 28-2 which is controlled by valve 38, and is where the compressed gas exiting the compression chamber C enters.

If outlets 32-1 and 32-2 are located as shown in FIGS. 1 and 2, then, of the pulsating gas components exiting the two outlets 32-1 and 32-2, those at the frequency of the reflected waves formed along the circumference of cavity 33 of the compressor shell 12 will undergo a 180° phase shift. This phase shift corresponds to one half the wavelength of the reflected wave. Since the pulsating gas components at this frequency interfere, they will tend to cancel each other out to decrease the amplitude significantly. The resonant mode sound occurs at the frequency where one wavelength of the reflected wave formed along the circumference is equivalent to the length of the sound cavity circumference, (i.e. the outer diameter of muffler 32). Consequently, the pulsating gas component at this frequency is amplified and the amplified pulsating gas oscillates in the compressor housing 1 to generate the noise at high amplitude.

In locating outlets 32-1 and 32-2 in muffler 32, the ideal location may be compromised as by the need for suitable locations for bolts 27 to secure muffler 32 in place. The gas path of concern is nominally along the outer circumference of muffler 32 from discharge port 28-2 to outlet 32-1. For a standing wave resonance to occur:

$$\frac{n\lambda}{2} = L$$

where n=1, 2, 3 . . . , λthe wave length and L=the gas path or circumferential distance of the annular shape. For a representative diameter of the annular space D, L=πD. Natural frequencies can be obtained from the classical relationships $$\lambda f = C_o$$

where f is the frequency and $C_o$ is the speed of sound. Thus, $$f = \frac{nC_o}{2L}$$

It is the object to locate the outlets so as to have the sound from the outlets 32-1 and 32-2 be out of phase to thereby cancel each other. This corresponds to locating outlets 32-1 and 32-2 180° apart relative to the frequency of interest. While the 180° separation is ideal, significant canceling can occur over an extensive range but 90°–270° separation relative to the frequency of interest is generally the limits of having a significant canceling without adding excessively to the noise where the phases add. Accordingly, L is given by the compressor geometry, the frequency range of concern is selected and n is determined. Where the frequency of concern is 600–650 Hz and the diameter D is 87.5 mm, L corresponds to approximately the circumference of annular space 33. Outlet 32-1 is ideally spaced from discharge port 28-2 to permit a dwell time in muffler 32. A distance of 20° up to 90° is acceptable. Canceling will occur down to one quarter wavelength if such is required by other design considerations as discussed above. The separation between outlets 32-1 and 32-2 in the direction of flows therefrom is ideally 180° of the frequency of interest.

Although a preferred embodiment of the present invention has been illustrated and described, other changes will occur to those skilled in the art. It is therefore intended that the scope of the present invention is to be limited only by the scope of the appended claims.

What is claimed is:

1. In a high side rotary hermetic compressor means having a shell bearing means and muffler means coacting to define an annular muffler chamber, a single discharge port overlain by said muffler chamber whereby said muffler chamber receives discharge gas passing through said discharge port the improvement comprising:

a pair of circumferentially spaced facing surfaces formed in said muffler means;

an outlet formed in each of said facing surfaces whereby discharge gas entering said muffler chamber passes therefrom via said outlets in a common plane but is opposing circumferential directions whereby noise canceling takes place.

2. The compressor means of claim 1 wherein said outlets are circumferentially spaced in facing relationship to 90°–270° apart relative to a frequency of interest.

3. The compressor means of claim 1 wherein said discharge port is separated from one of said outlets by 20°–90°.

4. The compressor means of claim 3 wherein said outlets are circumferentially spaced in facing relationship to 90°–270° apart relative to a frequency of interest.

* * * * *